United States Patent [19]

Meyer

[11] Patent Number: 4,486,048

[45] Date of Patent: Dec. 4, 1984

[54] LEG SUPPORT FOR A WHEELCHAIR

[75] Inventor: Wilhelm Meyer, Vlotho, Fed. Rep. of Germany

[73] Assignee: Meyra Krankenfahrzeug-fabrik Wilhelm Meyer GmbH & Co. KG, Vlotho, Fed. Rep. of Germany

[21] Appl. No.: 320,605

[22] Filed: Nov. 12, 1981

[30] Foreign Application Priority Data

Nov. 15, 1980 [DE] Fed. Rep. of Germany ..... 3043150

[51] Int. Cl.[3] ..... A47C 7/50

[52] U.S. Cl. ..... 297/433; 297/423; 297/435; 297/DIG. 4

[58] Field of Search ..... 297/436, 435, 434, 433, 297/423, DIG. 4

[56] References Cited

U.S. PATENT DOCUMENTS

| | | | |
|---|---|---|---|
| 1,440,329 | 12/1922 | Aime | 297/435 |
| 2,601,889 | 7/1952 | Everest et al. | 297/433 |
| 2,991,831 | 7/1961 | Jennings | 297/434 |
| 3,189,385 | 6/1965 | Mommsen | 297/433 X |
| 3,376,067 | 4/1968 | Kernes | 297/433 X |
| 3,854,774 | 12/1974 | Limpach | 297/433 X |
| 4,033,624 | 7/1977 | Jun | 297/434 |
| 4,343,482 | 8/1982 | Wegner | 297/DIG. 4 |

FOREIGN PATENT DOCUMENTS

| | | | |
|---|---|---|---|
| 996142 | 6/1965 | United Kingdom | 297/434 |
| 1416698 | 12/1975 | United Kingdom | 297/DIG. 4 |
| 1534049 | 11/1978 | United Kingdom | 297/DIG. 4 |

*Primary Examiner*—James T. McCall
*Attorney, Agent, or Firm*—Leonard Bloom

[57] ABSTRACT

A leg support for a wheelchair, comprising a vertical supporting tube, which is detachably mountable on said wheelchair, the upper end of said supporting tube having a horizontal arm mounted thereon, which arm extends in the direction of travel and on which arm a leg support carrier, supporting a foot-plate and a calf-plate, is pivotably mounted by means of its upper end, in which the leg support carrier is formed by an external telescopic tube and an internal telescopic tube inserted into the external telescopic tube, both tubes being pivotably mounted on the arm about their own respective swivel axles.

15 Claims, 4 Drawing Figures

LEG SUPPORT FOR A WHEELCHAIR

BACKGROUND OF THE INVENTION

The present invention relates to a leg support for a wheelchair for invalids, comprising a vertical supporting tube, which is detachably mountable on said wheelchair, a horizontal arm being mounted on the upper end of said tube, which arm extends in the direction of travel and on which arm a leg support carrier, supporting a foot-plate and a calf-plate, is pivotably mounted by means of its upper end.

Leg supports of wheelchairs are generally in abutment with the front end of the seat. The thighs of the person sitting in the wheelchair rest on the seat, while the knee and the shins, together with the feet, hang down in front of the seat and are to be supported by the leg support. In order to achieve a wheelchair which is as compact as possible and has small dimensions, the leg support should not project beyond the seat and should also not be located too far in front of the seat in the direction of travel, so that the person sitting in the wheelchair can step out sideways from the wheelchair, once an arm support has been removed and can, for example, put himself into a bed.

If these requirements are met, the design of the wheelchair is such that the swivel axle lies at the upper end of the leg support carrier below the knee joint of the leg to be supported. However, this forces the leg support carrier to be longitudinally adjustable. Since the swivel axle of the leg support carrier has to be situated not only beneath the knee joint axis, but also slightly behind it in order to be able to support the knee joint satisfactorily in each position, owing to the thickness of the leg, various swivel methods have been provided for the upwardly-pivoting movement of the leg support carrier and shin. The foot support, therefore, describes an arc of a circle whose radius is smaller than the radius of the circle which the foot describes, because the swivel axle of the leg support carrier is disposed lower than and behind the knee joint axis. The length of the leg support carrier, including the foot support is, as the radius, shorter than the length of the shin, including the foot, of the person.

In the case of known wheelchairs having an upwardly-pivotable leg support, the leg support has to be adjusted specially to the required length depending on the desirable, adjustment inclination. The person sitting in the wheelchair is often unable to do this, so that an additional helper becomes necessary solely for pivoting the leg support.

SUMMARY OF THE INVENTION

The object of the invention is to provide a leg support which automatically, during pivoting, is set to the length required to give satisfactory support to the shin and foot and which is automatically held in the pivoted position. In this case, the leg support should be able to be released easily again from the set position for fresh pivoting.

According to the present invention there is provided a leg support for a wheelchair, comprising a vertical supporting tube, which is detachably mountable on said wheelchair, the upper end of said supporting tube having a horizontal arm mounted thereon, which arm extends in the direction of travel and on which arm a leg support carrier, supporting a foot-plate and a calf-plate, is pivotably mounted by means of its upper end, in which the leg support carrier is formed by an external telescopic member or tube and an internal telescopic member or tube inserted into the external telescopic tube, both tubes being pivotably mounted on the arm about their own respective swivel axles.

The upper end of the internal telescopic tube is preferably mounted on the arm via a rear swivel axle, while the upper end of the external telescopic tube is mounted on one end of a control lever via a swivel axle, the other end of the control lever being mounted on the arm via a front swivel axle located in front of the swivel axle of the internal telescopic tube in the direction of travel.

The supporting tube and the leg support carrier are preferably additionally connected by an arresting device which enables the leg support carrier to pivot upwardly, but prevents it from pivoting downwardly, the arresting device comprising an actuating lever which, after actuation, permits the leg support carrier to pivot downwardly.

The many objects and advantages of the present invention will become apparent to those skilled in the art when the following description of the best mode contemplated for practising the invention is read in association with the accompanying drawings showing in a schematic manner and for illustrative purposes an example of apparatus for practising the invention, wherein.

DETAILED DESCRIPTION OF THE PREFERRED EMBODIMENT

Figure 1:
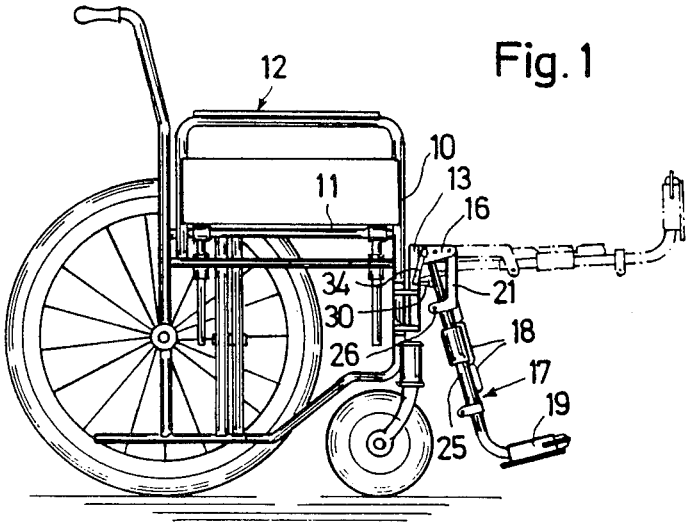
FIG. 1 is a side view of a wheelchair with a leg support in the downwardly-pivoted position; the upwardly-pivoted position of the leg support additionally being shown by dash-dot lines.

The leg support according to the invention is detachably mounted on the front frame 10, in front of the seat 11, of a wheelchair 12. Two bearing rings 14, mounted one above the other on the supporting tube 13, are located on two corresponding hinge-pins 15 mounted on the front frame 10. The leg support may be raised from the wheelchair 12 in this manner and, in addition, it may be pivoted about the hinge-pins 15 in order to improve the facilities for the person being transported to step in and out.

An arm 16, which extends in the direction of travel, is mounted on the upper end of the vertical supporting tube 13, and a leg support carrier 17, with a calf-plate 18 and a foot-plate 19, is hinged to said arm 16. The arm 16 comprises two vertical sheet-metal plates of equal area which are joined together by a transverse plate at their horizontal upper edges and which are mounted on the supporting tube 13 by means of their rear, vertical edges when viewed in the direction of travel.

A swivel axle 20 is mounted on the front end of the arm 16 and is enclosed by a bearing sleeve of a control lever 21. A rear swivel axle 22, which is enclosed by a bearing sleeve 23 mounted on the upper end of an internal telescopic tube 24, is disposed behind the front swivel axle 20 on intermediate portion of the arm 16.

The leg support carrier 17 is composed of the internal telescopic tube 24 and an external telescopic tube 25 into which the internal telescopic tube 24 is inserted. The calf-plate 18 and the foot-plate 19 are mounted on the external telescopic tube 25. This tube 25 is connected to the arm 16 via the control lever 21, and a swivel axle 26 is in fact disposed on the lower end of the control lever 21, this swivel axle 26 being enclosed by a bearing sleeve 27 mounted on the upper end of the external telescopic tube 25. The bearing sleeves 23 and 27 may, for example, be welded or soldered onto the telescopic tubes 24 and 25.

Figure 2:
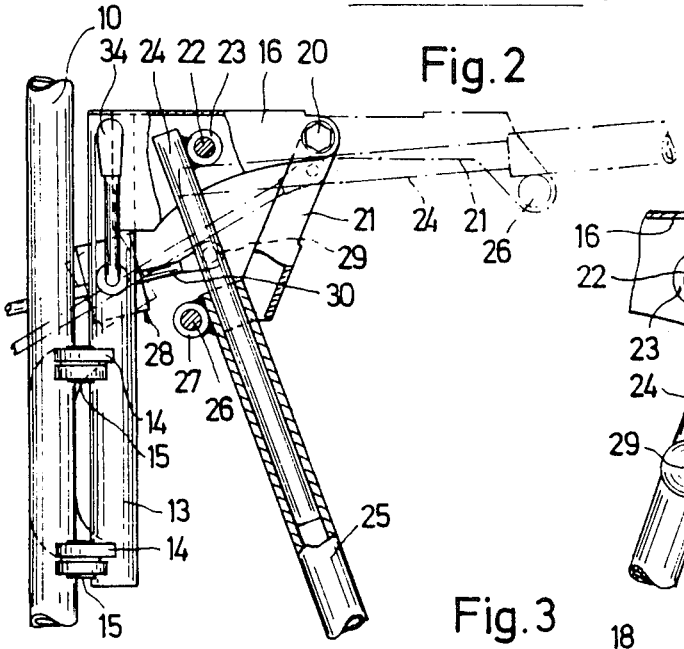
FIG. 2 is a side view, with a partial, vertical section, of the connecting region between the supporting tube, the arm, and the internal and external telescopic tubes of the leg support.
Figure 4:
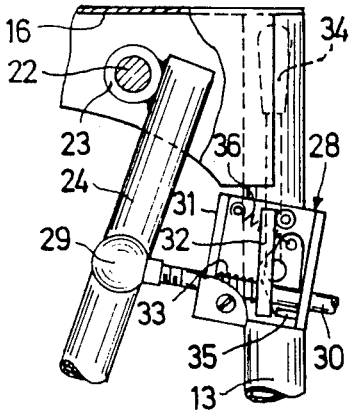
FIG. 4 is a rear view of the connecting region between the supporting tube and the internal telescopic tube of the leg support shown in FIG. 2, including the opened housing of the arresting device.
Figure 3:
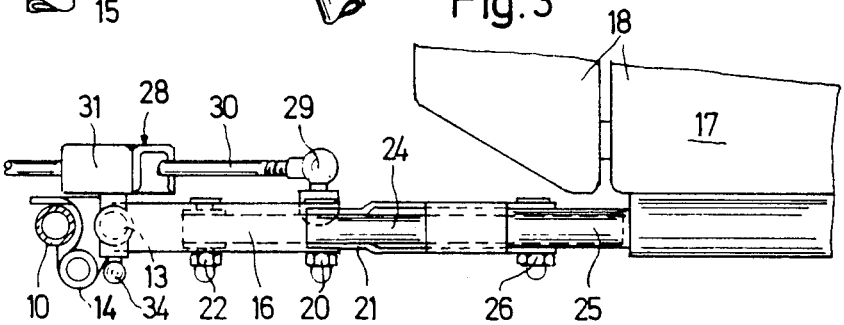
FIG. 3 is a plan view of the leg support in the upwardly-pivoted position.

When the leg support carrier 17 is pivoted upwardly, the internal telescopic tube 24 rotates about the rear swivel axle 22. The external telescopic tube 25 has to participate in this pivotal movement since it is located on the internal telescopic tube 24. Since, however, the external telescopic tube 25 is hinged, via the control lever 21 to the front swivel axle 20 of the arm 16, the external telescopic tube 25 has to be drawn partially away from the internal telescopic tube 24 when the internal telescopic tube 24 pivots upwardly, so that the overall length of the leg support carrier 17, composed of the internal telescopic tube 24 and the external telescopic tube 25, becomes longer. When the leg support carrier 17 pivots upwardly, it therefore becomes longer, whilst, when it pivots downwardly, it becomes shorter again. The extent of the elongation depends therefore, on the length of the control lever 21 and the distance between the front swivel axle 20 and the rear swivel axle 22 on the arm 16. The extension of the leg support carrier 17 may, for example, be 80 mm if the carrier 17 adopts the horizontal position, i.e. if the control lever 21 forms approximately the horizontal extension of the arm 16, as shown by dash-dot lines in FIG. 2.

In order that the leg support carrier 17 stops in a specific, upwardly-pivoted position and does not fall back again, an arresting device 28 is mounted on the leg support. This arresting device 28 comprises a push-rod 30, which is hinged, via a ball joint 29 to the internal telescopic tube 24 and can be clamped securely in a housing 31 hinged to the supporting tube 13. For this purpose, a bolt 32, having a bore formed therein, is mounted in the housing 31, the push-rod 30 passing through the bore. A compression spring 33 acts upon the bolt 32, so that the bolt 32 adopts a clamping position relative to the push-rod 30. The bolt 32 is pivoted slightly, its bore thereby tilting relative to the push-rod 30 and the bolt 32 thereby preventing the push-rod 30 from moving in the direction of its longitudinal axis.

The bolt 32 is pivotably mounted in the housing 31 so that it prevents the push-rod 30 from moving only in one direction. This is the direction which corresponds to the downward-pivoting of the leg support carrier 17. When the leg support carrier 17 is pivoted upwardly, i.e. the push-rod 30 is moved in the opposite direction along its axis, the push-rod 30 first draws the bolt in opposition to the action of the compression spring 33 which acts upon the bolt 32, and thereby pivots it out of the clamping position, so that the push-rod 30 is able to pass through the bore formed in the bolt 32. The leg support carrier 17 is thus able to pivot upwardly at any time unhindered.

In order to be able to pivot the upwardly-pivoted leg support carrier 17 downwardly again, the arresting device 28 must be brought from the clamping position into a releasing position. The housing 31 of the arresting device 28 must be hinged to the supporting tube 13 so that the housing 31 can be set at any time to the inclination of the push-rod 30 during the upwardly- and downwardly-pivoting of the leg support carrier 17. To release the bolt 32, an actuating lever 34 is mounted on the supporting tube 13 and acts upon a cam 35 disposed inside the housing 31. By actuating the lever 34, the cam 35 is moved towards the bolt 32 and urges the bolt, in opposition to the action of the compression spring 33, so far along the push-rod 30 until the bolt 32 has adopted a pivoted position which unclamps the push-rod 30.

Disposed inside the housing 31, there is a tension spring 36 which acts upon the actuating lever 34 and keeps the lever 34 in the non-actuated state, in an end position in which there is a slight clearance between the lock 32 and the cam 35. When the lever 34 is non-actuated, therefore, the push-rod 30 is clamped securely, so that the leg support carrier 17 firmly retains its position, once set. When the lever 34 is actuated, the push-rod 30 is unclamped, so that the leg support carrier 17 can then be pivoted unhindered both upwardly and downwardly. If a desirable position is reached with the leg support carrier 17, then the actuating lever 34 is released and the leg support carrier 17 is secured by the arresting device 28.

We claim:

1. In a wheelchair having a seat and front frame, the improvement comprising the provision of a leg support therefor, said support having a vertical supporting tube, which is detachably mountable on said front frame of said wheelchair, the upper end of said supporting tube having a horizontal arm rigidly mounted thereon and extending forwardly therefrom in the direction of travel of the wheelchair, a leg support carrier, supporting a foot-plate and a calf-plate, wherein the leg support carrier is formed by an external telescopic member and an internal telescopic member inserted into the external telescopic member, the members having respective upper end portions, means pivotably mounting the upper end of the inner telescopic member to an intermediate portion of the horizontal arm, and lever means having one end pivotably mounted to the upper end of the external telescopic member, the lever means further having an other end pivotably mounted to a forwardly-extending portion of the horizontal arm.

2. The improvement as recited in claim 1, wherein the respective telescopic members comprise an external telescopic tube and an internal telescopic tube, wherein the means pivotably mounting the upper end of said internal telescopic tube comprises a real swivel axle, wherein the lever means comprises a control lever, wherein the control lever is pivotally mounted to the upper end of the external telescopic tube via a swivel axle, and wherein the other end of the control lever is pivotably mounted on the arm via a front swivel axle located in front of the swivel axle of the internal telescopic tube in the direction of travel.

3. The improvement as recited in claim 2, in which a bearing sleeve is mounted on the internal telescopic tube and the rear swivel axle, supported by the arm, is inserted through said bearing sleeve.

4. The improvement as recited in claim 2, wherein a bearing sleeve is mounted on the external telescopic tube and the swivel axle, supported by the control lever, is inserted through said bearing sleeve.

5. The improvement as recited in claim 2, wherein a bearing sleeve is mounted on the control lever, and the front swivel axle, supported by the arm, is inserted through said bearing sleeve.

6. The improvement as recited in claim 4 or 5, wherein the means for mounting the bearing sleeves of the telescopic tubes is a soldered or welded connection.

7. The improvement as recited in claim 1, wherein the arm is formed from two sheet-metal cover-plates of equal area which are mounted on the supporting tube.

8. The improvement as recited in claim 2, wherein the control lever is formed from two sheet-metal cover-plates of equal area which are mounted on the bearing sleeve of the control lever.

9. The improvement as recited in claim 1, wherein the supporting tube and the leg support carrier are additionally connected by an arresting device which enables the leg support carrier to pivot upwardly, but prevents it from pivoting downwardly.

10. The improvement as recited in claim 9, wherein the arresting device comprises an actuating lever which, after actuation, permits the leg support carrier to pivot downwardly.

11. In a wheelchair having a seat and front frame, the improvement comprising the provision of a leg support therefor, said support having a vertical supporting tube, which is detachably mountable on said front frame of said wheelchair, the upper end of said supporting tube having a horizontal arm mounted thereon, which arm extends in the direction of travel and on which arm a leg support carrier, supporting a foot-plate and a calf-plate, is pivotably mounted by means of its upper end, wherein the leg support carrier is formed by an external telescopic tube and an internal telescopic tube inserted into the external telescopic tube, both tubes being pivotably mounted on the arm about their own respective swivel axles, wherein the supporting tube and the leg support carrier are additionally connected by an arresting device which enables the leg support carrier to pivot upwardly, but prevents it from pivoting downwardly, wherein the arresting device comprises an actuating lever which, after actuation, permits the leg support carrier to pivot downwardly, and wherein the actuating lever and a housing of the arresting device are mounted, with a common axis, on the supporting tube, whereby a push-rod, hinged to the internal telescopic tube, can be clamped securely within the housing and can be released when the lever is actuated.

12. In a wheelchair, the combination of supporting means carried by the wheelchair, an arm fixed to the supporting means and extending forwardly therefrom, a leg support means including a pair of members telescopically arranged with respect to each other, means pivotably mounting one of the telescopic members to an intermediate portion of the arm, lever means having respective ends, means pivotably mounting one of the ends of the lever means to the forwardly-extending portion of the arm, and means pivotably mounting the other end of the lever means to the other telescopic member, further including arresting means arranged between the supporting means and the leg support means, the arresting means enabling upward pivoting movement of the leg support means, but precluding downward pivoting movement thereof, and an actuating lever to release the arresting means and allow downward pivoting movement of the leg support means.

13. The improvement as recited in claim 11, wherein the push-rod is clamped securely by means of a bolt which is acted upon by a compression spring, the push-rod being inserted through the bore formed in the bolt.

14. The improvement as recited in claim 13, wherein the bolt is displaceable by a cam, mounted on the axle of the actuating lever, in opposition to the action of the compression spring and is pivotable into the releasing position.

15. The improvement as recited in claim 14, wherein the actuating lever with the cam is held by a tension spring in a position which releases the bolt.

* * * * *